US006311355B1

(12) United States Patent
Ruuska

(10) Patent No.: US 6,311,355 B1
(45) Date of Patent: Nov. 6, 2001

(54) SWEEPER

(75) Inventor: Mauno Ruuska, Vammala (FI)

(73) Assignee: Pairia Vammas Oy, Vammala (FI)

( * ) Notice: Subject to any disclaimer, the term of this patent is extended or adjusted under 35 U.S.C. 154(b) by 0 days.

(21) Appl. No.: 09/655,279

(22) Filed: Sep. 5, 2000

(51) Int. Cl.[7] ..... E01H 5/00; E01H 1/05
(52) U.S. Cl. ..... 15/82; 15/78
(58) Field of Search ..... 15/82, 78, 79.1

(56) References Cited

PUBLICATIONS

Sweepster S3100B; Brochure by Sweepster, Inc. of Dexter. MI; undated (but believed to be prior art).

*Primary Examiner*—Randall E. Chin

(74) *Attorney, Agent, or Firm*—Larson & Taylor PLC

(57) ABSTRACT

A movable sweeper having a frame to which a rotatable cylindrical brush is coupled, a flap arrangement locating at least in front of the rotatable brush with the flap leading brushed loose water and snow to the side, an adjustable support wheel for controlling the height of the sweeper and a mechanism for adjusting the distance between the flap arrangement and the brush. The sweeper includes a rotatable axle, which has a plurality of fixing arms locating on the outer surface of the axle, a plurality of connection rods being fixed to the arms from their ends and the rods transmitting adjusting motion for the supporting wheel and the flap arrangement when the axle is rotated by an activator, like a hydraulic cylinder with the activator being fixed to the frame from its one end and to the arm on the axle from its other end.

6 Claims, 2 Drawing Sheets

1
2
3
4
5
6
7
8
9
10
11
12
13
14
15
16
17
18
19
20
21
22
23
24
25
27
28
29
30
31
35
36

3
4
5
6
9
10
12
13
14
15
16
17
18

3
6
13
15
18

SWEEPER

FIELD OF THE INVENTION

The invention relates to a movable sweeper for cleaning large flat areas such as airport runways. The sweeper comprises a broad cylindrical brush which is rotated round its axle, a flap arrangement for leading loose water, snow and particles to the side and further supporting wheels by means of which the working height of the brush is adjusted.

BACKGROUND OF THE INVENTION

The earlier known sweepers have separate adjusted support wheels and separate adjusted flap constructions in front of the rotatable brush and also some types have it moreover behind the brush. The height of the brush from the cleaned surface is adjusted and maintained by means of the support wheels. The position of said wheels in relation to the frame of the machine can be changed. By said height adjustment different contact areas can be achieved i.e. the contact length in the surface in the working direction of the brush can be adjusted larger or smaller.

The rotating brush in use easily transports light particles around it and may be back to the cleaned surface. In order to prevent this drift, the flap arrangement in front of the brush is used to lead loose material out of the brush. Also similar construction behind the brush is used. When the brush wears, the separate brush wires becomes shorter and thus the brush diameter becomes smaller. It follows that the support wheels have to be lifted in relation to the frame and the flap arrangements have to be moved nearer the brush. The sweepers of earlier known types have inconvenient adjustments separately for support wheels and flaps. The present invention provided for eliminating this disadvantage.

BRIEF SUMMARY OF THE INVENTION

By means of this invention, all adjustments can be carried out at the same time using only one activator which preferably is a hydraulic cylinder. The support wheels are lifted, i.e. the brush is lowered, and the flap arrangements are moved towards the brush simultaneously. The adjustment is easy and fast to use.

BRIEF DESCRIPTION OF THE DRAWINGS

In the following the invention is explained by referring to the enclosed drawings, wherein.

DETAILED DESCRIPTION OF THE INVENTION

Figure 1:
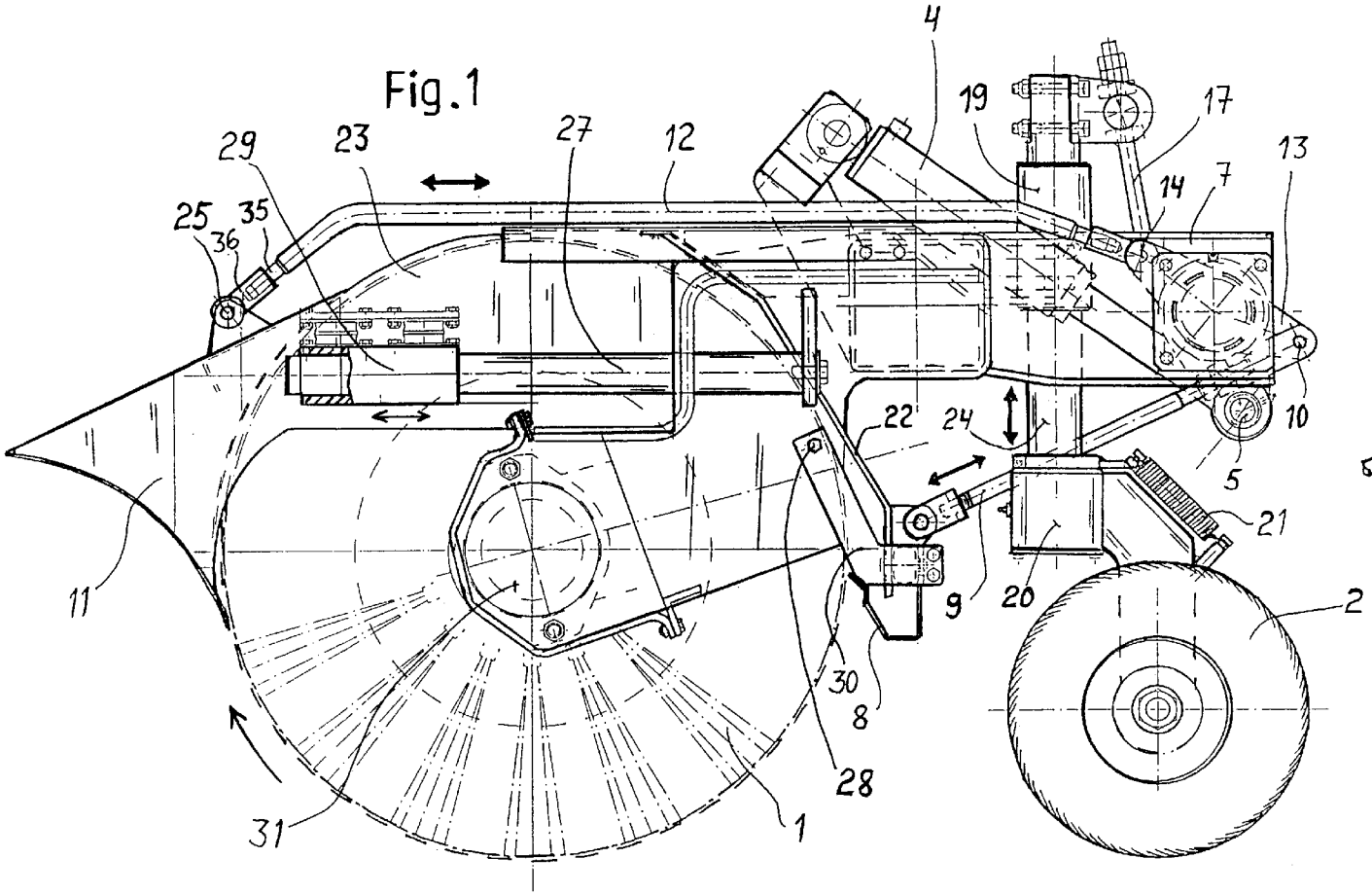
FIG. 1 is a side view of a sweeper.

In the FIG. 1 there is shown a sweeper having a frame 7, a rotatable brush 1 mounted with a bearing system on said frame construction, a hydraulic motor 31 to rotate said brush and a support wheel 2 fixed to said frame. The support wheel 2 can be lifted and lowered in relation to the frame 7. A sleeve 19 is fixed to the frame 7 and the vertical axle 24 of the support wheel 2 can move inside said sleeve vertically. In the lower end of said vertical axle there is located bearing 20 allowing the wheel 2 to turn. Spring 21 keeps the wheel in the desired direction.

The frame 7 comprises a horizontal directed axle 3 the outer surface of which axle 3 has an arm 18. The connection rod 17 from the support wheel height adjustment system is lead to the arm 18 and fixed thereto with a joint 16. By rotation of the axle 3, the support wheel 2 can be lifted and lowered.

The axle 3 rotation is controlled by means of an activator, like a hydraulic cylinder 4, the upper end of said cylinder 4 is fixed to said frame 7 and the lower end is fixed with a joint 5 to an arm 6. The arm 6 is also fixed on the axle 3. In front of the brush 1 there is a flap arrangement which can be moved horizontally forward and backwards. The frame 7 has guiding means, rails or similar gliding bars 27 on which the flap 11 can be moved. A gliding sleeve 29 is mounted on each bar 27 and fixed to the flap 11. The motion for the flap 11 is transmitted by a respective rod 12 from a respective arm 15, each said arm 15 being fixed to the outer surface of the axle 3. Between each arm 15 and rod 12 there is a respective joint 14. By turning of the axle 3 in one direction or the other, the flap arrangement is selectively moved towards the brush center or, more likely, away from said center. The flap arrangement comprises the front flap 11 and a shield 23 extending to the brush top and partly extending to the side area of the brush top.

Behind the brush 1 there is a rear flap arrangement which can collect loose particles and water, comprising a channel 8 and a shield 22. The shield 22 extends to the top of the brush. The rear flap arrangement (channel 8 and shield 22) can be moved towards the brush axle by means of articulated arm 30, articulated with a joint 28 to a side sheet portion of the frame 7. The motion for the rear flap arrangement (channel 8 and shield 22) is transmitted by a rod 9 from the arm 13 to which the rod 9 is fixed by a joint 10. The arm 13 is fixed to the outer surface of the axle 3.

As an alternative embodiment, the rear flap arrangement (channel 8 and shield 22) can also be fixed on each gliding bar 27 through another respective sleeve 29 instead of arm 30 and joint 28 wherein the linear motion can also be obtained for the rear flap.

When the adjusting axle 3 is rotated by the cylinder 4 and arm 6, each arm 13, 15, 18 (FIG. 2*a*) is turning simultaneously with the others. By the elected lengths of said arms, the motion distances of the wheel and the flaps can be adjusted. The preferred solution is that by the elected arm lengths the motion distances of the flaps 11, 8 towards the brush center become the same as the adjusted distance upwards of the support wheel 2. The motion distances of the flaps 11, 8 depend on the adjusted motion in the vertical direction of the wheel 2. It is moreover advantageous that the lengths of each of the connection rods 9,12 and 17 can also be adjusted, for example by equipping at least one end of each connection rod with thread 35 and on said thread 35 screwed threaded coupling sleeve 36 (FIG. 1).

Figure 2A:
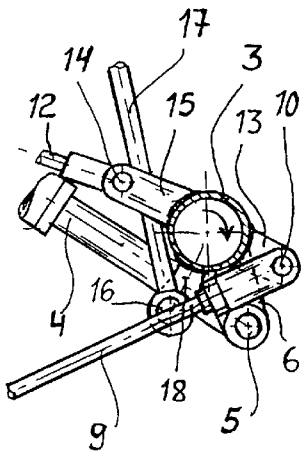
FIG. 2*a* is a side view of an adjusting axle having arms for a plurality of connection rods fixed to said arms.
Figure 2B:
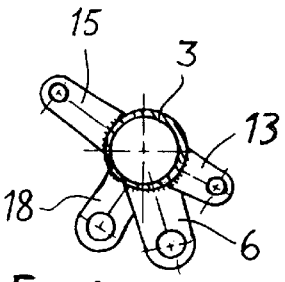
FIG. 2*b* is a side view of an adjusting axle having arms.

In the FIG. 2*a* there are shown only (a) the rotatable adjusting axle 3, (b) arms 6, 13, 15 and 18 extending from axle 3, and (c) joints 5, 10, 14 and 16 by which said arms are connected to associated connection rods 9, 12, 17 and cylinder 4. In the FIG. 2*b* the connection rods are removed.

Figure 3:
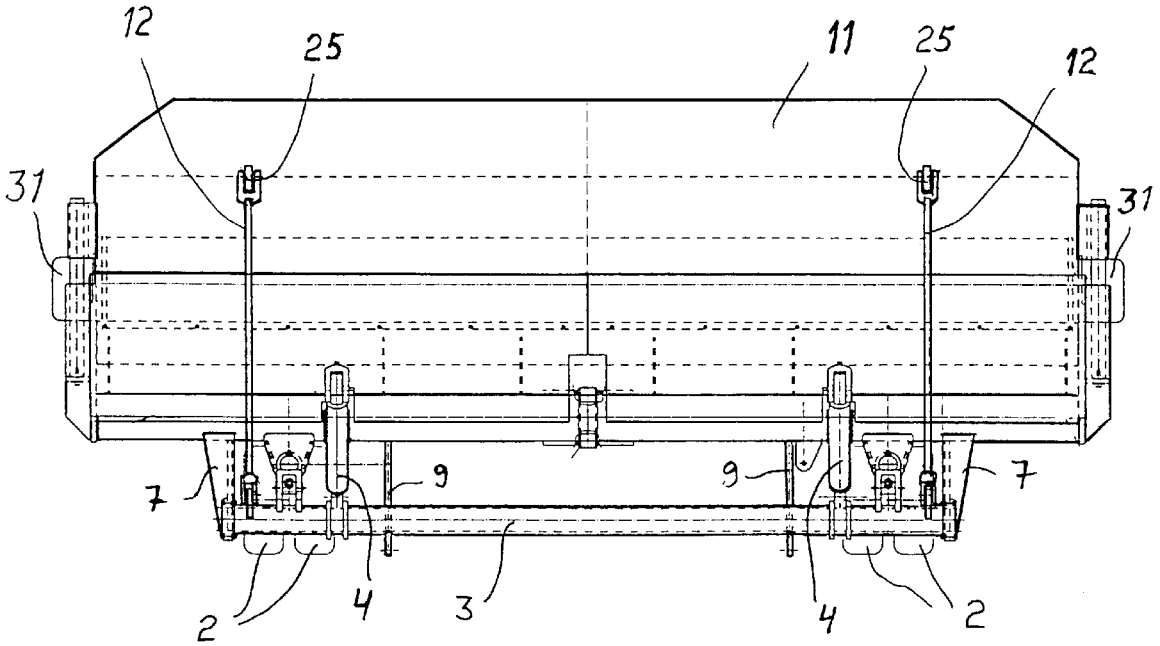
FIG. 3 is a top view of the brush machine.

In FIG. 3 there is shown as a top view the whole sweeper. The adjusting axle 3 comprises bearings on both ends, and said axle is rotatably coupled to the frame 7 by means of said bearings. The sweeper can be constructed very broad, for example 4–6 meters. It is therefore advantageous to use two or more parallel mounted rods for flaps and two activators such as cylinders 4 as presented in FIG. 3.

Figure 4:
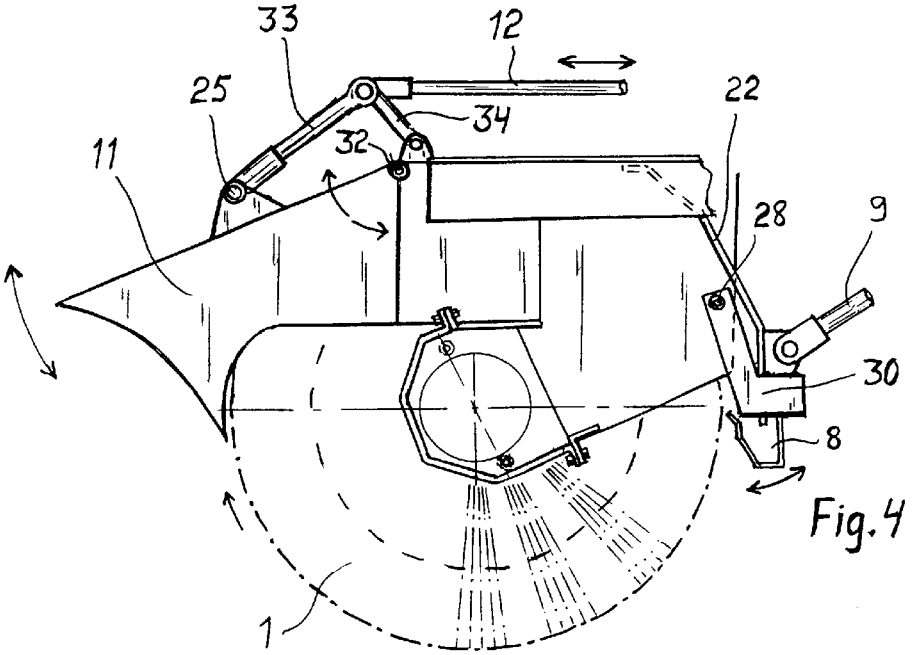
FIG. 4 is a side view of a brush with an alternative flap construction.

In FIG. 4 there is a flap construction system comprising hinged front flap 11 which is moved by means of the rod 12. The hinge point 32 is on the flap top and said flap 11 is turned by means of the rod 12. In order to secure reliable operation, the system may comprise, as presented, auxiliary articulated arms 33 and 34. The flap 11 can also be turned up for facilitating the removing of the brush.

As an activator, previously described as a cylinder 4, also a screw system producing linear motion can be used. Also in such an embodiment it is moreover possible that the activator is first connected to move, for example, the vertical axle 24 of the wheel 2 while adjusting the brush height. The rod 17 is rotating in this case the axle 3. Also the activator can be connected first to move one of the flap arrangements wherein the rod 9 or 12 is mounted to turn the axle 3.

I claim:

1. A movable sweeper comprising:

a frame;

a rotatable cylindrical brush which is coupled to said frame;

a flap arrangement adjustably attached to said frame so that a distance between said flap arrangement and said brush is adjustable, said flap arrangement also being located at least in front of said rotatable brush, said flap arrangement leading brushed loose water, snow and particles to one side of said frame;

a support wheel adjustably attached to said frame so that a working height of said frame is adjustable; and an adjustment mechanism by which the distance and working height are adjusted, said adjustment mechanism including a) a rotatable axle, b) respective flap and wheel fixing arms attached to an outer surface of said axle, c) respective flap and wheel connection rods fixed at proximal ends thereof to said flap and wheel arms respectively, whereby said flap and wheel rods respectively transmit an adjusting motion respectively for said support wheel and said flap arrangement when said axle is rotated, and d) an activator having a distal end fixed to said frame and a proximal end coupled to said axle such that activation of said activator causes rotation of said axle and hence adjustment of the distance and working height simultaneously.

2. A sweeper as claimed in claim 1, wherein said proximal end of said activator is coupled to said axle by an activator arm connected to the outer surface of said axle.

3. A sweeper as claimed in claim 1, further including a second adjustable flap arrangement located behind said brush.

4. A sweeper as claimed in claim 3:

wherein lengths of said fixing arms and connection rods are selected so that said flap arrangements both move radially towards a brush axle of said brush and so that said wheel moves vertically; and wherein motion distances of said flap arrangements during radial movement thereof are dependent on a motion distance in the vertical direction for said support wheel.

5. A sweeper as claimed in claim 3:

wherein said flap arrangements are moved towards said brush when said support wheel is lifted up by said activator; and wherein said activator is a hydraulic cylinder.

6. A sweeper as claimed in claim 1, further including a second flap fixing arm attached to an outer surface of said axle and a second flap connection rod coupled from said second flap fixing arm to said flap arrangement, said second flap fixing arm and said second flap connection rod being parallel to respective first-mentioned said flap fixing arm and said flap connection rod.

* * * * *